US006409473B1

(12) United States Patent
Chen et al.

(10) Patent No.: US 6,409,473 B1
(45) Date of Patent: Jun. 25, 2002

(54) LOW STRESS CONNECTION METHODOLOGY FOR THERMALLY INCOMPATIBLE MATERIALS

(75) Inventors: E-June Chen, Scottsdale; Bjoern Schenk, Phoenix; Ramesh Bapat, Mesa; I. Gene Fowkes, Tempe; Brian Gracias, Phoenix; Shen-Yeh Chen; Taison Ku, both of Tempe; Josef Paluch, II, Avondale, all of AZ (US)

(73) Assignee: Honeywell International, Inc., Morris Township, NJ (US)

( * ) Notice: Subject to any disclaimer, the term of this patent is extended or adjusted under 35 U.S.C. 154(b) by 38 days.

(21) Appl. No.: 09/604,386

(22) Filed: Jun. 27, 2000

(51) Int. Cl.[7] ..... F01D 1/02
(52) U.S. Cl. ..... 415/191; 415/209.4; 415/210.1
(58) Field of Search ..... 415/135, 137, 415/138, 139, 191, 209.3, 209.4, 210.1, 915

(56) References Cited

U.S. PATENT DOCUMENTS

| | | | | |
|---|---|---|---|---|
| 3,784,320 A | | 1/1974 | Rossmann et al. | |
| 3,809,495 A | | 5/1974 | Stahl | |
| 4,040,770 A | | 8/1977 | Carlson | |
| 4,169,694 A | | 10/1979 | Sanday | |
| 4,323,394 A | | 4/1982 | Hoffmuller et al. | |
| 4,349,203 A | | 9/1982 | Schulke | |
| 4,417,854 A | | 11/1983 | Cain et al. | |
| 4,471,008 A | | 9/1984 | Huther | |
| 4,732,862 A | | 3/1988 | Ito et al. | |
| 4,955,423 A | * | 9/1990 | Blazek | 164/35 |
| 4,961,459 A | * | 10/1990 | Blazek | 164/122.1 |
| 5,087,174 A | | 2/1992 | Shannon et al. | |
| 5,264,295 A | | 11/1993 | Yoshikawa et al. | |
| 5,290,143 A | | 3/1994 | Kington et al. | |
| 5,584,652 A | * | 12/1996 | Shaffer, et al. | 415/115 |
| 6,000,906 A | * | 12/1999 | Draskovich | 415/209.4 |

* cited by examiner

*Primary Examiner*—Edward K. Look
*Assistant Examiner*—Ninh Nguyen
(74) *Attorney, Agent, or Firm*—Robert Desmond, Esq.

(57) ABSTRACT

An assembly comprising a ceramic vane with a metal housing cast around the ends of the vane. The ceramic vane has dovetailed shaped grooves along its edges that extend from the vane's leading edge to its trailing edge. The housing is comprised of two spaced apart walls each having dovetailed protrusions for mating with the dovetail grooves in the vanes's edges. Upon the casting of the walls to the vane at least one surface of each dovetail groove comes in contact with at least one surface of the dovetail protrusion. A crushable coating is disposed between the vane's edges and the dovetail protrusions.

8 Claims, 3 Drawing Sheets

LOW STRESS CONNECTION METHODOLOGY FOR THERMALLY INCOMPATIBLE MATERIALS

TECHNICAL FIELD

This invention relates generally to turbine vanes in gas turbine engines and a bicast assembly of a ceramic vane to a to metal housing.

BACKGROUND OF THE INVENTION

It has long been recognized that the efficiency and performance of gas turbine engines could be improved by increasing the temperature of the gas through the turbine section. Historically, these temperatures have been limited by the materials, usually high temperature steel or nickel alloy, used to form the first stage stator vanes. To permit higher gas temperatures it has been proposed to form the first stage stator vanes from a high density, high strength, silicon nitride, or silicon carbide ceramic which can withstand higher temperatures than steels or nickel alloys. However, the use of ceramic stator vanes necessitates a ceramic-to-metal interface at which the difference in thermal expansion between the ceramic vane and the metallic support structure must be accommodated so that the vanes remain fixed relative to the structure despite temperature changes in the gas. It also necessitates that the ceramic-to-metal interface prevent the vanes from twisting when subjected to aerodynamic loads.

Bicasting is a method used to form turbine stators. This method includes casting the shroud around the tip and root edges of prefabricated vanes. The advantage to bicasting is that the vanes and shroud can be formed from materials having different compositions. Kington et al. U.S. Pat. No. 5,290,143 discloses one such bicast stator.

A problem that has arisen in casting ceramic vanes to metal casings or housings is the need to accommodate the large thermal growth mismatch between the ceramic and the metal. If not dealt with properly, this mismatch will induce stress levels in the vanes and casing that may lead to a failure of a part during service.

Accordingly, there is a need for a cast assembly of a ceramic vane to a metal housing that can accommodate thermal growth mismatch.

SUMMARY OF THE INVENTION

An object of the present invention is to provide a cast assembly of a ceramic vane to a metal housing that better accommodates thermal growth mismatch.

The present invention achieves this object by providing a bicast assembly comprising a ceramic vane with a metal housing. The ceramic vane has dovetailed shaped grooves along it edges that extend from the vane's leading edge to its trailing edge. The housing is comprised of two spaced apart walls each having dovetailed protrusions for mating with the dovetail grooves in the vane's edges. Upon the casting of the walls to the vane at least one surface of each dovetail groove comes in contact with at least one surface of the dovetail protrusion.

A crushable coating is disposed between the vane's edges and the dovetail protrusions.

The dogbone shaped connectors between the vane and the walls generates a very low stress condition in the ceramic vane. This allows for local thermal growth differentials associated with the casting process, engine operation and room temperature while at the same time ensuring positive contact of the vane at engine operation to prevent vibration or other functional problems associated with loose vanes.

These and other objects, features and advantages of the present invention, are specifically set forth in, or will become apparent from, the following detailed description of a preferred embodiment of the invention when read in conjunction with the accompanying drawings.

DESCRIPTION OF THE PREFERRED EMBODIMENT

Figure 1:
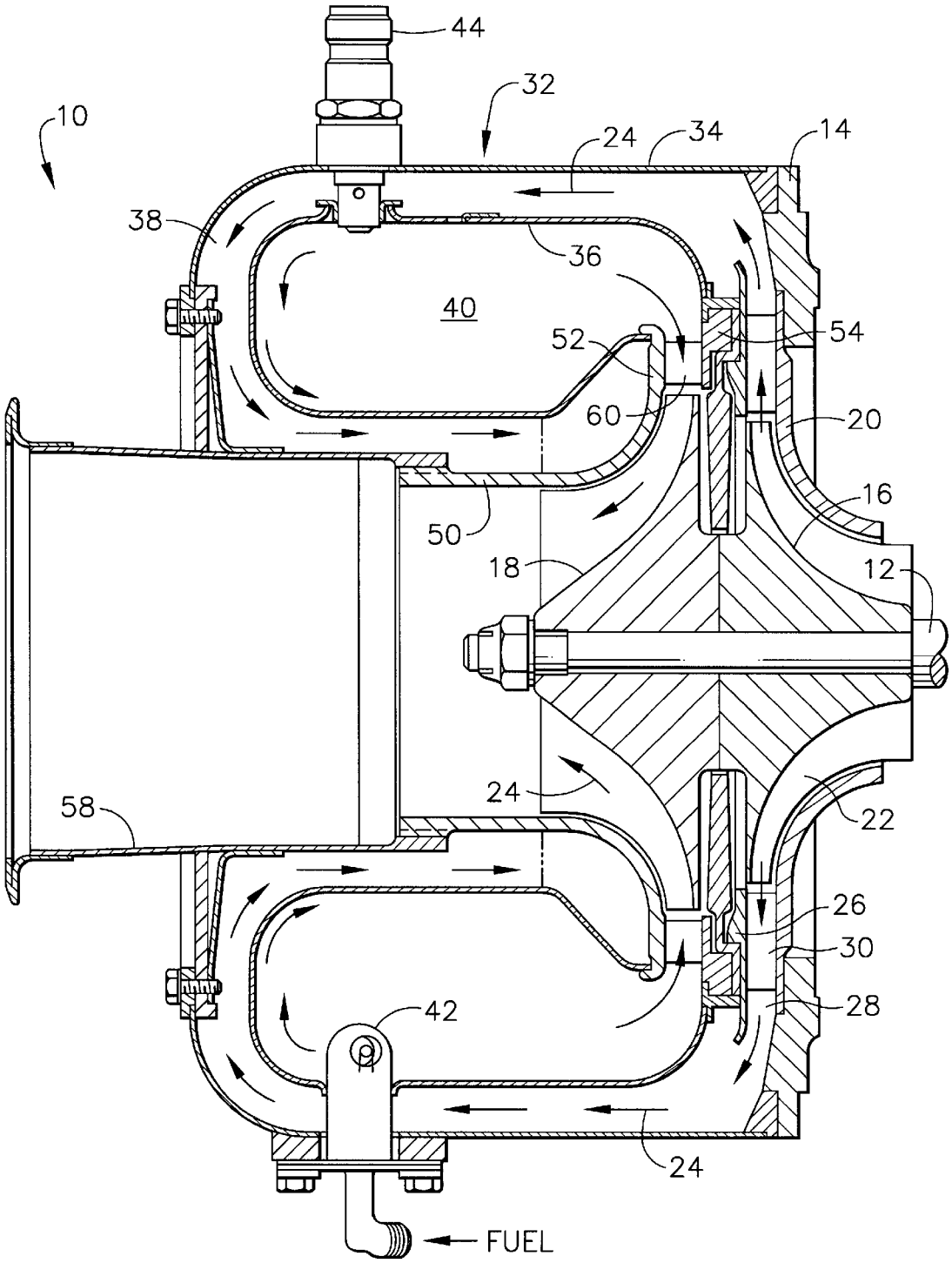
FIG. 1 is a cross-sectional view of a gas turbine engine in which the bicast assembly contemplated by the present invention may be used.

Referring to the drawings, FIG. 1 shows a gas turbine engine generally denoted by reference numeral 10. The engine type selected for illustrating the invention is an engine having a centrifugal compressor and a radial turbine. It should be appreciated that the invention is equally applicable to other type of engines such as those having axial compressors and axial turbines. The engine 10 has a rotor assembly including a shaft 12 journaled for rotation inside a casing 14. Mounted to the shaft is a compressor rotor 16 and a turbine wheel 18. The casing 14 includes a compressor housing portion 20 circumscribing an impeller 22 which is disposed within a flow path represented by the arrows 24. Axially spaced apart from the housing portion 20 is an annular wall 26 that together define a diffuser passageway 28. Disposed across the diffuser passageway 28 are a plurality of circumferentially disposed diffuser vanes 30.

From the diffuser vanes 30 compressed air flows into a reverse flow annular combustor 32. The combustor 32 has an outer liner 34 spaced apart from an inner liner 36 to define an air plenum 38 therebetween. Within the inner liner 36 resides a combustion chamber 40. Air from the plenum 38 has a plurality of slots or orifices, not shown, through which air enters the combustion chamber 40 where it mixes with fuel from a fuel injector 42. The mixture of air and fuel is ignited by an igniter 44 and resulting hot gas flows from the combustor to the turbine.

The casing 14 also includes a turbine portion 50 having a flaring portion 52 which is spaced apart from an annular wall 54 to define a gas passageway therebetween. The annular walls 26 and 54 may be opposite sides of a single wall or part of an assembly disposed between the compressor rotor 16 and turbine wheel 18. Mounted to the flaring portion 52 and annular wall 54 are a plurality of circumferentialy disposed ceramic vanes 60 which when combined with 52 and 54 form nozzles. The nozzles direct the hot gas from the combustor 32 across the wheel 18 where the gas expands causing the turbine wheel 18 to rotate. After expansion, the hot gas is expelled through an exhaust duct 58.

Figure 2:
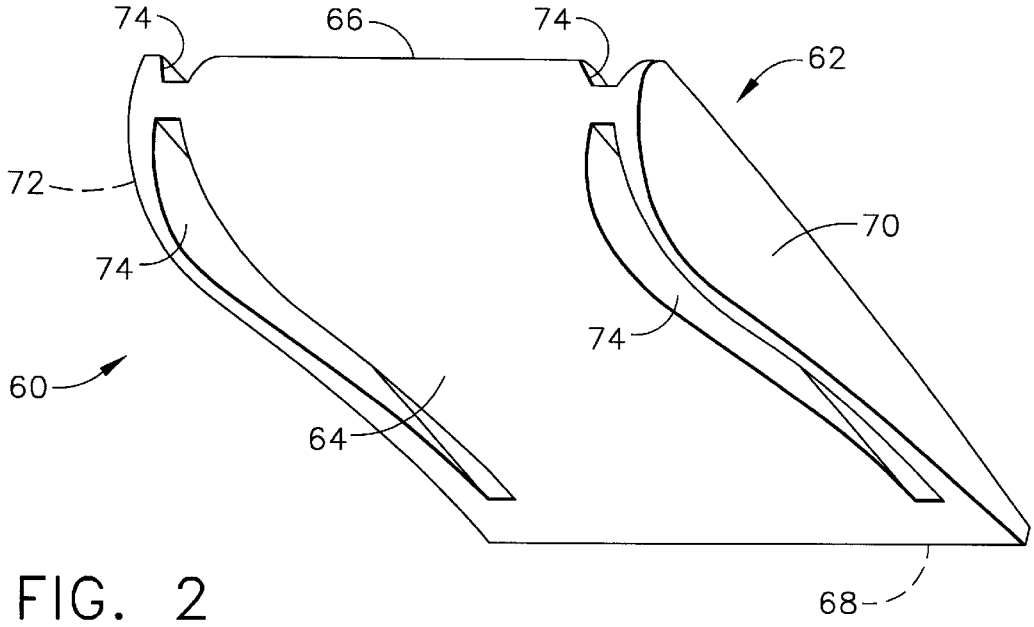
FIG. 2 is an exploded view of a ceramic nozzle of the bicast assembly contemplated by the present invention.

Referring to FIG. 2, each of the ceramic vanes 60 has an airfoil shape with a concave or pressure side 62 and a convex or suction side 64. The degree of concavity being referred to as the vane's camber. Following conventional blade or vane terminology, the sides 62 and 64 are bounded by a rounded leading or upstream edge 66, a thin, rounded trailing or downstream edge 68, and first and second edges 70, 72 extending from the leading edge 66 to the trailing edge 68. On both the pressure and suctions side 62,64 slightly spaced from the edges 70, 72, each of the vanes has a groove 74 extending from the leading edge 66 to the trailing edge 68.

Figure 3:
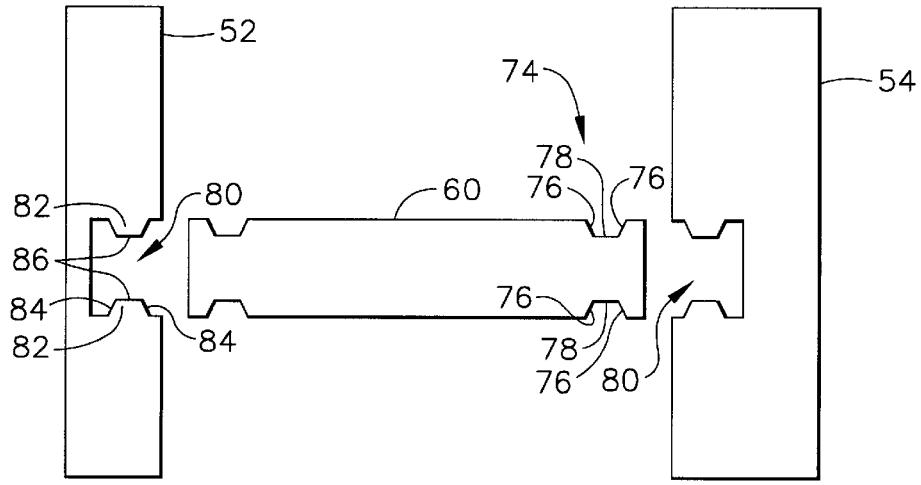
FIG. 3 is a cross-sectional schematic of the bicast assembly contemplated by the present invention.
Figure 3A:
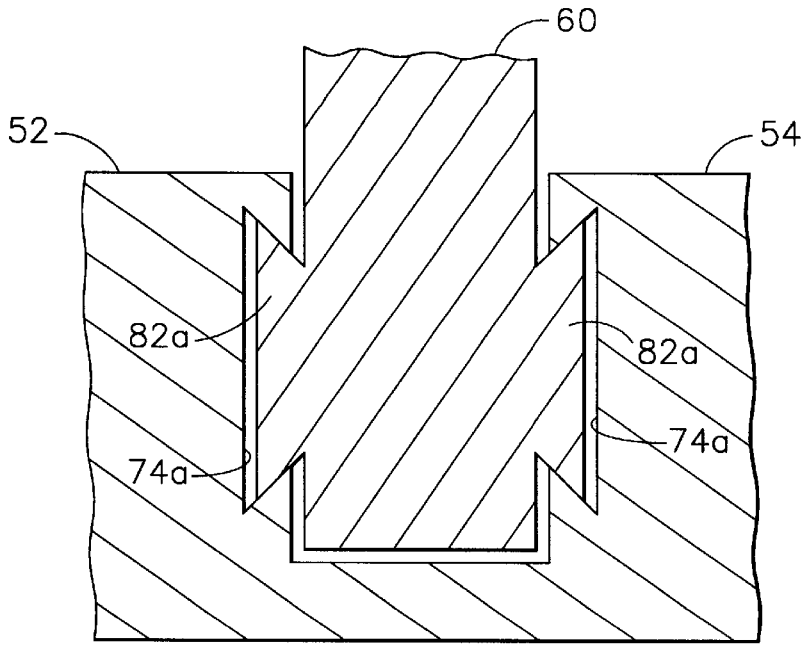
FIG. 3A is an illustration of an alternative embodiment of the assembly of FIG. 3.

Referring now to FIG. 3, each of the metal walls 52 and 54 has a dovetail groove 80 having a protrusion 82 extending therealong. The dovetail shape is defined by two angled surface 84 connecting at a straight surface 86. The grooves 74 are also dovetailed as defined by two angled surface 76 connecting to a straight surface 78. When mated together the protrusions 82 and grooves 74 create a dogbone connector with mating dovetail sections. FIG. 3A shows an alternative embodiment of a cross connector with dovetail like sections. In this embodiment, the dovetail grooves 74*a* are in the walls 52 and 54 and dovetail protrusions 82*a* are on the vanes 60. The dogbone connector is used in situations where the housing or the outer part is of material having a larger thermal expansion coefficient than that of the vane or inner part, (i.e. metal housing encapsulating the ceramic vane). Where the situation is reversed the cross connector configuration is preferred.

Figure 4:
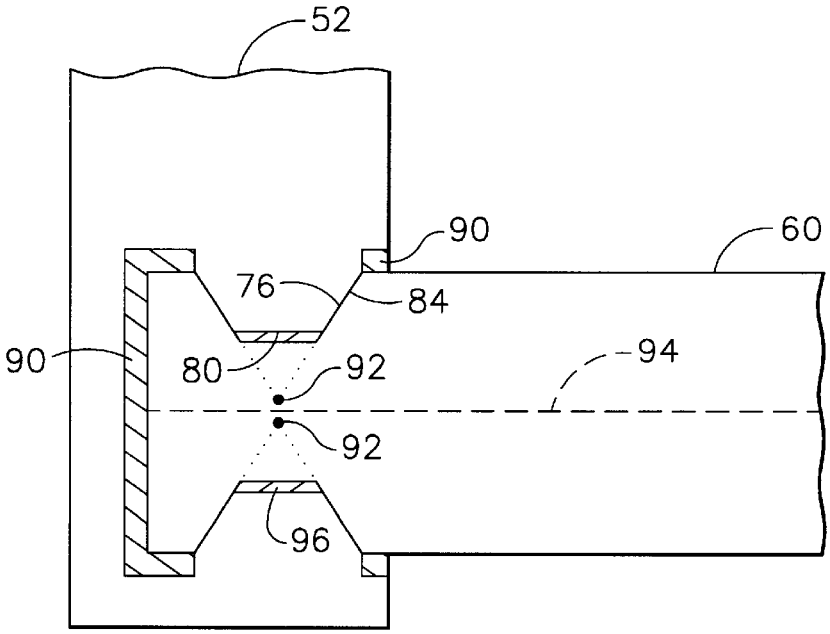
FIG. 4. is a blown up illustration of a portion of FIG. 3.

The following description is made with reference to wall 52, but applied equally to wall 54. Referring to FIG 4, a crushable coating 90 is applied around the portion of the vane that is to be encapsulated by the groove 80 during the bicasting process. The coating is commercially available and is selected so that it will deform under compressive load allowing the metal to shrink around the vane while generating little stress in the vane or wall, while still being able to withstand typical gas turbine engine temperatures. The thickness of the coating will depend of the thermal expansion properties of the metal and ceramic. In the preferred embodiment the thickness of the coating will be uniform. Importantly, the coating is not present on surfaces 76 during the casting process. Once the coating 90 is applied, the vane 60 is installed in the casting mold and the walls 52 and 54 are cast around it.

After bicasting the surfaces 76 contact the surfaces 84. This selective contact allows the vane to remain in tight contact with the wall to ensure that they are held in position during engine operation while other surfaces of the wall 52 can expand and contract as the temperature in the engine changes. To keep the stresses in the ceramic vane low, the surfaces 84, should be angled so that their respective projected apex 92 falls as close to the centerline and axis of symmetry 94 of the thickest airfoil section of the nozzle. For this configuration when the apex 92 is moved away from the centerline line 94 and closer to the surface 78 the stresses increase. When point apex 92 crosses over the centerline 94 and moves toward the opposite surface 78, the stress will be low, but surfaces 76 will lose contact with surface 84.

This dogbone shaped connectors between the vane and the walls generates a very low stress condition in the ceramic vane. This allows for local thermal growth differentials associated with the casting process, engine operation and room temperature while at the same time ensuring positive contact of the vane at engine operation to prevent vibration or other functional problems associated with loose vanes.

It should be appreciated that though the present invention has been described with respect to mounting a ceramic vane in a metal housing, the invention can be used for coupling any two parts so long as the parts are made of different materials that have a thermal expansion incompatibility. Further, the two parts need not be components for a gas turbine engine.

Therefore, various modifications and alterations to the above-described preferred embodiment will be apparent to those skilled in the art. Accordingly, these descriptions of the invention should be considered exemplary and not as limiting the scope and spirit of the invention as set forth in the following claims.

What is claimed is:

1. A bicast assembly comprising:

a ceramic member bounded by a leading edge, a trailing edge, and first and second edges extending from the leading edge to the trailing edge, said first and second edges having dovetail grooves forming a dogbone shape;

a first and second metal walls spaced apart, each of said walls having a first and second groove, respectively, said first and second groove having protrusions forming a dogbone shape; and said first and second shapes selected so that when said first and second walls are bicast around said first and second edges respectively, at least one surface of said first and second edges contacts at least one surface of said first and second grooves respectively.

2. The assembly of claim 1 wherein said ceramic member is an airfoil.

3. A bicast assembly comprising:

a ceramic member bounded by a leading edge, a trailing edge, and first and second edges extending from the leading edge to the trailing edge, said first and second edges having a first shape;

a first and second metal walls spaced apart, each of said walls having a first and second groove respectively said first and second groove having a second shape; and said first and second shapes selected so that when said first and second walls are bicast around said first and second edges respectively, at least one surface of said first and second edges contacts at least one surface of said first and second grooves respectively, wherein said first and second shapes are selected to produce, after bicasting, a cross shaped connector between said first wall and said first edge and between said second wall and said second edge.

4. A bicast assembly comprising:

a ceramic member bounded by a leading edge, a trailing edge, and first and second edges extending from the leading edge to the trailing edge, said first and second edges having a first shape;

a first and second metal walls spaced apart, each of said walls having a first and second groove respectively said first and second groove having a second shape;

said first and second shapes selected so that when said first and second walls are bicast around said first and second edges respectively, at least one surface of said first and second edges contacts at least one surface of said first and second grooves respectively; and a crushable coating between said first edge and said first groove and between said second edge and said second groove.

5. A bicast assembly comprising:

a ceramic member bounded by a leading edge, a trailing edge, and first and second edges extending from the leading edge to the trailing edge, said first and second edges having a first shape;

a first and second metal walls spaced apart, each of said walls having a first and second groove respectively said first and second groove having a second shape;

said first and second shapes selected so that when said first and second walls are bicast around said first and second edges respectively, at least one surface of said first and second edges contacts at least one surface of said first and second grooves respectively, wherein said first shape is a dovetail groove and said second shape is a dovetail protrusion, and wherein said dovetail groove is defined by first and second equally angled surfaces connecting at a first straight surface.

6. The assembly of claim 5 wherein said dovetail protrusion is defined by third and fourth equally angled surfaces connecting at a second straight surface.

7. The assembly of claim 6 wherein said contacting surfaces are said first and third angled surfaces and said second and fourth angled surfaces.

8. The assembly of claim 7 wherein said first, second, third and fourth surfaces are angled so that their projected apex falls close to the axis of symmetry of the thickest section of the ceramic member.

* * * * *